US005224909A

United States Patent [19]

Hamilton

[11] Patent Number: 5,224,909

[45] Date of Patent: Jul. 6, 1993

[54] MID-BODY EXERCISE DEVICE

[76] Inventor: John R. Hamilton, 3212 W. Vandeloo, Tucson, Ariz. 85746

[21] Appl. No.: 878,167

[22] Filed: May 4, 1992

[51] Int. Cl.[5] ..... A63B 21/00

[52] U.S. Cl. ..... 482/70; 482/51; 128/25 R

[58] Field of Search ..... 482/51, 52, 70, 71, 482/142, 54; 128/25 R

[56] References Cited

U.S. PATENT DOCUMENTS

| | | | |
|---|---|---|---|
| 326,247 | 9/1885 | Root . | |
| 3,363,335 | 1/1968 | Durhns et al. | 482/70 |
| 3,460,272 | 8/1969 | Pellicore | 128/25 R |
| 3,582,069 | 6/1971 | Flick | 482/70 |
| 3,976,058 | 8/1976 | Tidwell . | |
| 4,529,194 | 7/1985 | Haaheim | 482/70 |
| 4,628,909 | 12/1986 | Tietsworth | 482/51 |
| 4,679,786 | 7/1987 | Rodger | 482/70 |
| 4,900,013 | 2/1990 | Rodgers, Jr. | 482/70 |

FOREIGN PATENT DOCUMENTS

| | | | |
|---|---|---|---|
| 1225674 | 8/1987 | Canada | 482/70 |

*Primary Examiner*—Stephen R. Crow
*Assistant Examiner*—J. Donnelly
*Attorney, Agent, or Firm*—Schmeiser, Morelle & Watts

[57] ABSTRACT

The invention is a bi-level exercise apparatus in which a user assumes a crawling position and then moves arm and leg receiving slides in a back and forth motion. The slides are attached to tracks that constrain the movement of the slides to a linear, horizontal path. The apparatus further includes a gear train assembly that provides resistance to the rearward movement of the slides but allows the slides to move in a forward direction substantially without resistance.

19 Claims, 3 Drawing Sheets

MID-BODY EXERCISE DEVICE

FIELD OF THE INVENTION

The invention is in the field of exercise equipment. More particularly, the invention is a device designed primarily to strengthen a user's mid-body muscles. The invention can also be used to strengthen a user's arm and leg muscles and to improve a user's overall coordination. To achieve this result, the invention makes use of two pairs of limb receiving slides that are moveable along associated horizontal tracks. The slides are interconnected and are positioned with the arm receiving slides located forward and above the leg receiving slides.

BACKGROUND OF THE INVENTION

There are many different types of exercise equipment available to a user. A person will normally have some goal in mind as to which muscles he or she wishes to improve. The user will then choose the particular machine or apparatus accordingly. For example, barbells are used to strengthen the arms and upper torso. A leg press is effective for improving a user's leg muscles.

For a user wishing to improve the mid-body muscles of the lower back and abdomen, there are two primary types of devices for this purpose. These devices require the user to either perform a sit-up motion or a rowing motion.

Sit-up devices normally include one portion that restrains the user's ankles and another portion that supports the user's body in a supine position. These devices commonly are in the form of an elongated platform that has a "T"-shaped ankle securing member proximate one end. The end of the platform may be attached at any one of a number of vertically-spaced points to a vertically-oriented support.

The second form of machine for improving a user's mid-body muscles is typified by a rowing machine. In this type of device, the user sits atop a support (often horizontally movable) and pulls back with his or her arms and upper body against a resistance.

SUMMARY OF THE INVENTION

The invention is a bi-level exercise device designed primarily to strengthen a user's mid-body muscles and to reduce the size of the user's waist. The device also functions to improve a user's coordination.

The invention includes two arm receiving slides that support the distal portion of a user's arms. The device also includes two leg-receiving slides that support the distal portion of a user's legs. All four of the slides are interconnected and movable on a track system.

The two arm-receiving slides are located on a top portion of the device and move horizontally on parallel tracks. Each of these slides is designed to receive the user's elbow and at least a portion of the forearm. When the slide is moved toward a front end of the device, it freewheels on an underlying gear and therefore moves substantially without resistance. However, rearward movement of the slide causes a gear train to rotate thereby creating a resistance to the slide's movement.

The two leg-receiving slides are located toward the rear of the device and are located at a lower level than the arm slides. The leg slides are adapted to receive the user's leg from the knee to the foot. Like the arm slides, the leg slides move horizontally on parallel tracks and are allowed to freewheel when they are moved in a forward direction. When either of the leg slides is moved rearwardly, a gear train is caused to move, thereby creating a resistance to the rearward movement of the slide.

The gear train comprises two rotatable shafts that are preferably interconnected by a chain assembly. One of the shafts is directly actuated by the arm slides and the other is directly actuated by the leg slides. Since the shafts are preferably interconnected, rearward movement of any one slide causes both shafts to rotate. An adjustable brake assembly may also be connected to the gear train to enable the resistance to the rearward movement of the slides to be varied. It should be noted that since the slides are preferably interconnected by the gear train, a single brake assembly is able to apply a resistance to the rearward movement of all of the slides simultaneously.

The device can be used by either a male or female user. To simplify the descriptions of use, a male user will be described.

When a user is properly positioned on the device, he assumes a crawling position with the distal portions of his limbs located in the associated slides and his back in a level horizontal position. The user can then practice a crawling movement on the device to achieve a strengthening of the torso muscles as well as the muscles of the arms and legs. At the same time, this type of movement will improve the user's coordination. As such, the device can also be used as a rehabilitative aid for a handicapped or injured user.

When a user wishes to focus his exercising efforts on the mid-body muscles of the abdomen and lower back, he moves the slides in a coordinated back and forth motion. The user simultaneously moves the arm and leg slides toward the middle of the device while arching his back. The user then simultaneously moves the arm slides forward and the leg slides rearward until the user again assumes the starting position with his back in a level position.

Alternatively, the user holds a centrally-located, vertically-extending handle with both of his hands to thereby prevent the arm slides from moving. The user then moves the rear slides in a simultaneous back and forth motion to again causes an arching and then leveling of his back. It should be noted that the user predominantly relies on the abdomen, lower back and leg muscles to cause the above noted movement of the leg slides.

DETAILED DESCRIPTION OF THE DRAWINGS

Figure 1:
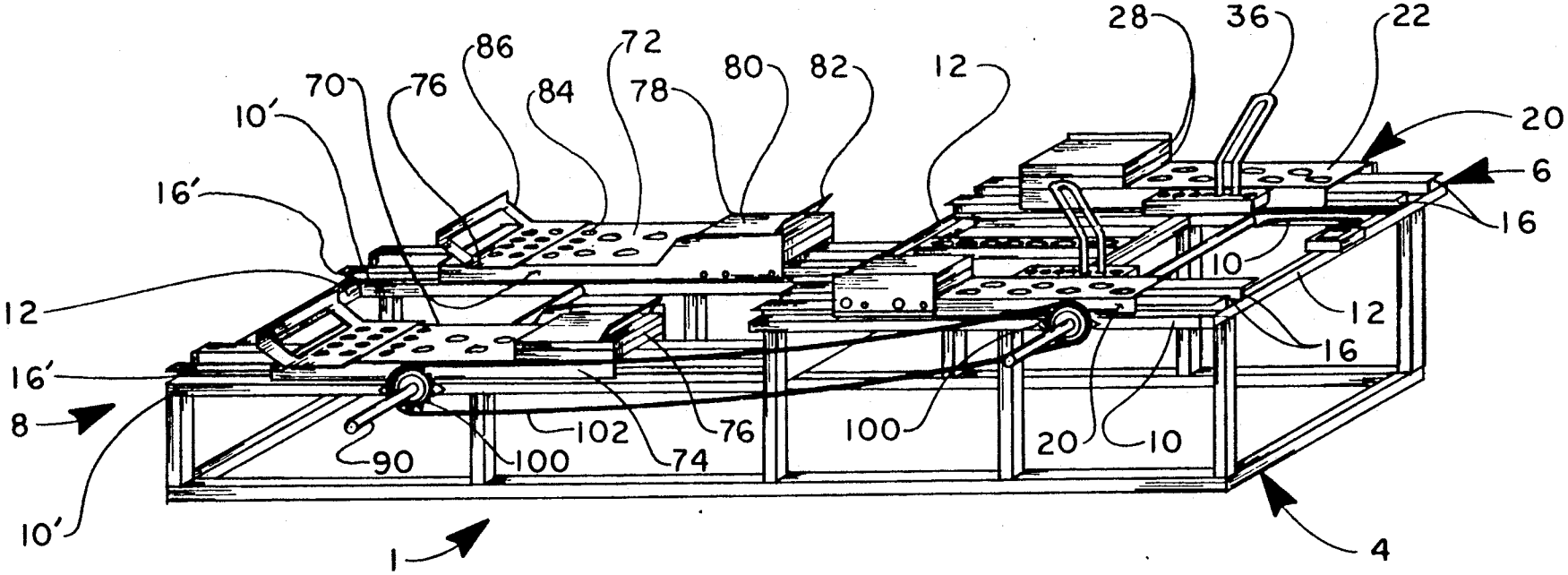
FIG. 1 is a perspective view of an exercise device in accordance with the invention.
Figure 4:
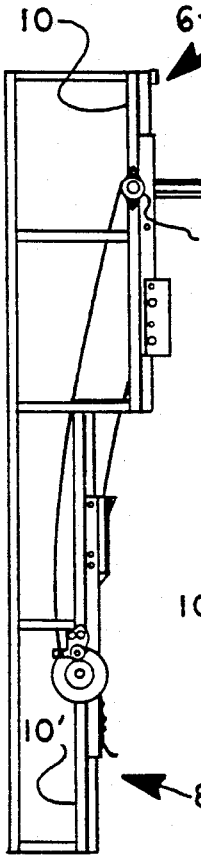
FIG. 4 is a left side view of the device shown in FIG. 1.
Figure 2:
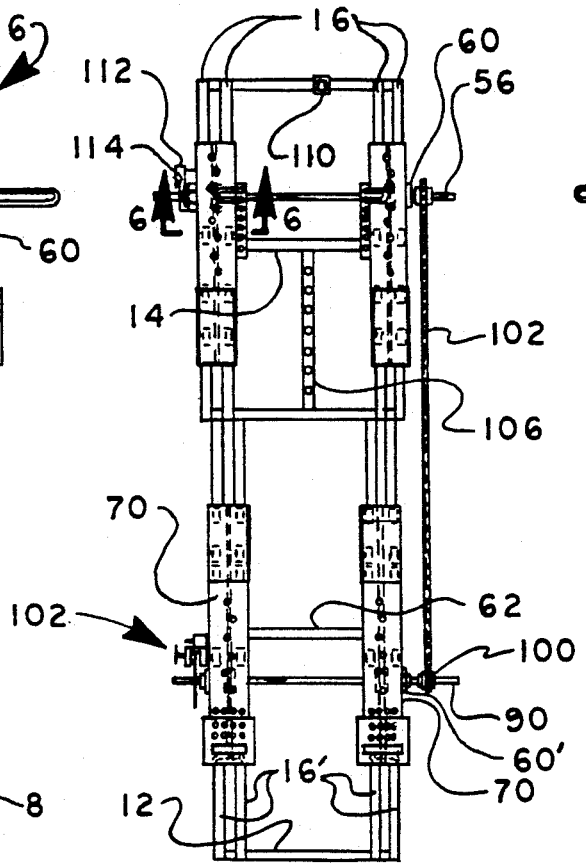
FIG. 2 is a plan view of the exercise device shown in FIG. 1.
Figure 3:
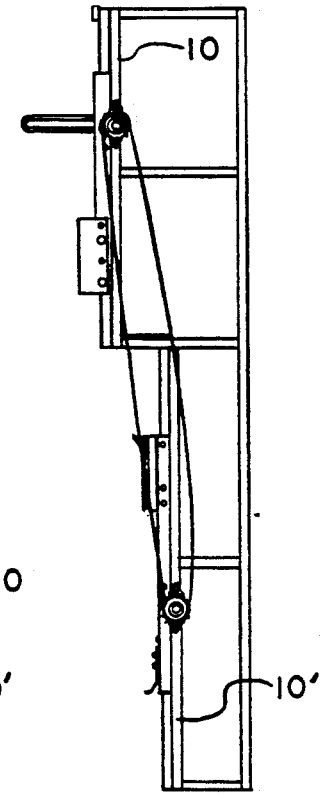
FIG. 3 is a right side view of the device shown in FIG. 1.
Figure 5:
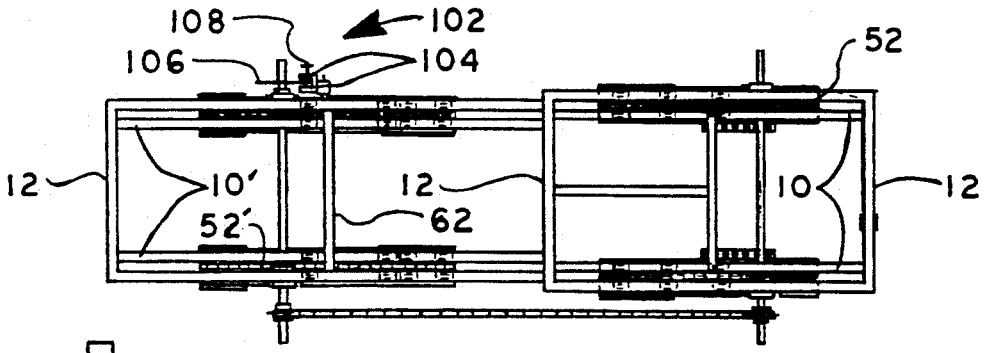
FIG. 5 is a bottom view of the device shown in FIG. 1.

Referring now to the drawings in greater detail, wherein like reference characters refer to like parts throughout the several figures, there is shown by the numeral 1 an exercise device in accordance with the invention. The device includes a base structure 4 that supports a forward platform 6 and a rearward platform 8. The device is considered to have two levels since the forward platform is located approximately six inches higher than the rearward platform.

The forward platform comprises two pairs of horizontally-oriented elongated members 10. The elongated members are joined at their front and rear ends by cross-members 12. An intermediary cross-member 14 connects two of the members 10 proximate their midpoints.

Figure 6:
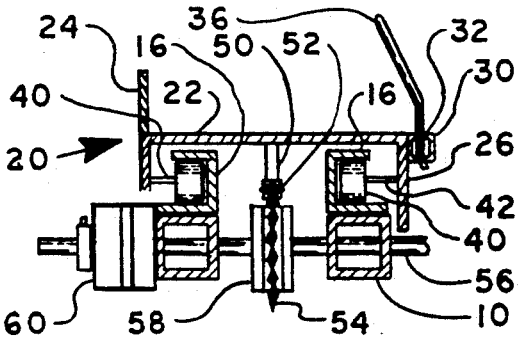
FIG. 6 is a detailed cross-sectional view of one of the slides as secured by the channel structure of the support frame.

Located atop each member 10 is "C"-shaped channel 16 oriented with the opening facing to the side (note FIG. 6). Each of the channels extends the full length of the upper platform.

Resting atop the channels and axially slidable thereon are a pair of arm support slides (slide members) 20. Each slide is associated with one of the pairs of members 10.

The slides are identical and each includes a flat, top support surface 22, an outer side member 24 (note FIG. 6) and an inner side member 26. The outer side member 24 extends above the slide's support surface. As shown in FIG. 1, one or more block members 28 (two are shown) may be placed atop the support surface to allow the user to achieve a proper positioning atop the device. The use of removable blocks additionally allows the user to somewhat control the amount of stress placed upon his mid-body muscles. By adjusting the level of his torso when he is on the device, the user affects the difficulty of the exercise.

Secured to a forward portion of the inner side 26 of each slide is a bracket 30. The bracket includes a plurality of horizontally-spaced apertures 34 that form a plurality of vertically oriented thru-bores in the bracket. In the preferred embodiment, each slide includes a bifurcated grip member 36 that is received within any two adjacent apertures 34. The grip member is designed to be grasped by the user's hand and travels with the associated slide. The plurality of apertures allows the grip to be moved toward the forward or rearward end of the bracket to thereby allow the slide to accommodate and properly fit the size of a user's forearm.

FIG. 6 provides a detailed cross sectional view of one of the slides 20 located atop the support members 10 and channels 16.

The underside of each slide includes a plurality of easily rotatable wheel members 40 that are secured to the slide's inner and outer sides by axles 42. The wheels are received within the channels 16 thereby supporting the slide. The channels form a retaining track for the wheels of the slide thereby functioning to constrain the slide to a linear horizontal path in only a forward or rearward direction. Each of the wheels includes bearings (not shown) to ensure that there is only minimal resistance from the track system to the forward or rearward motion of the slide.

Extending downwardly from the underside of the slide's support surface 22 is a rigid support bracket 50. The bracket extends the full length of the slide and has affixed to its bottom surface a length of chain 52. The chain is intermeshed with a gear 54 that is fixed to a first rotatable shaft 56 by a one-way clutch member 58.

When the slide is moved in either a forward or rearward direction, gear 54 is caused to rotate as the chain is moved across the positionally fixed gear. The clutch member allows the gear to rotate shaft 56 whenever the slide is moved in a rearward direction (toward the rear of the device). When the slide is moved in a forward direction, the clutch member allows the gear to freewheel on the shaft without causing the shaft to turn.

The shaft 56 passes through both pairs of members 10 and is rotatably secured by two bearings 60 located proximate the outer ends of the shaft. Each bearing 60 is secured to one of the members 10.

The rear platform 8 of the device is essentially similar to the front platform with only minor exceptions.

The rear platform comprises two pairs of horizontally oriented elongated members 10'. The elongated members are joined at their front and rear ends by cross-members 12. An intermediary cross-member 62 connects two of the members 10' proximate their midpoints.

Located atop each member 10' is a "C"-shaped channel 16' that is oriented with the channel opening facing to the side (in the same manner as shown in FIG. 6). Each of the channels extends the full length of the rear platform.

Resting atop the channels and axially slidable thereon are a pair of leg support slides (slide members) 70. Each slide is associated with one of the pairs of members 10'. The two slides are identical and each includes a flat support surface 72, an outer side 74 and an inner side 76. The forward portion of each leg support slide includes a block-like rigid member 78 with padding 80 located on its top surface. The extreme front portion of the block has an upwardly extending member 82 that gives the forward portion of the padding a concave shape thereby adapting it to receive the lower front portion of a user's knee. It should be noted that blocks similar to blocks 28 may be placed atop member 78 to achieve a comfortable and horizontally level orientation of the user's leg between the knee and ankle.

The rear portion of the slide's support surface includes a plurality of spaced aperture sets 84. Adjustably fixed to the apertures by standard fasteners is a toe-receiving member 86. The member can be adjustably secured forward or rearward on the slide by securing it with the fasteners to a different set of the apertures 84.

The underside of each of the rearward slides is basically identical to that of the forward slides and FIG. 6 can again be used as a general guide. The underside of the support surface includes a central support bracket (equivalent to bracket 50) that has a longitudinally extending chain 52' attached to its bottom surface. The chain is intermeshed with a gear 54' that is secured to a second rotatable shaft 90 by a one way clutch member 58'. When one of the leg slides is moved in a rearwards direction, the clutch member allows the gear to cause the shaft to rotate. Forward movement of either leg slide causes the gear to freewheel on the shaft due to the clutch member and therefore does not cause the shaft to rotate. The shaft 90 extends through the members 10' and is supported at each end by bearings 60'.

In the preferred embodiment, a gear assembly is used to interconnect the two shafts 56 and 90. The assembly includes two gears 100 that are located on the right side of each of the shafts 56 and 90. Each gear is fixed to the associated shaft and turns whenever the shaft is turned. The gear assembly further includes a continuous chain 102 that encircles the two gears 100 thereby interconnecting them. Whenever one of the gears 100 rotates, the chain causes the other gear 100 to rotate. In this manner, the rotation of the two shafts is interconnected. Rearward movement of any of the slides will cause not only its associated shaft to rotate but the other shaft to rotate as well. It should be noted that as an alternate embodiment, the two shafts 56 and 90 can be independent of each other.

Attached to the base proximate the left side of the rear shaft is a brake assembly 102. The assembly is composed of a pair of manually positionable brake pads 104 that can adjustably act on a disk 106 that is fixed to the rear shaft 90. By turning handle 108, a user can adjust the contact between the pads and disk thereby adjust the resistance to rotation of the rear shaft. It should be noted that the brake simultaneously affects the rotational resistance of the front shaft since both shafts are interconnected by the gear assembly.

To enable the user to measure his progress, a speedometer assembly 110 is mounted on the front crossmember 12 of the device. The device has a pickup 112 located adjacent the left side of the forward shaft 56. A pickup actuator 114 is fixed to shaft 56 and is rotatable therewith.

Figure 7B:
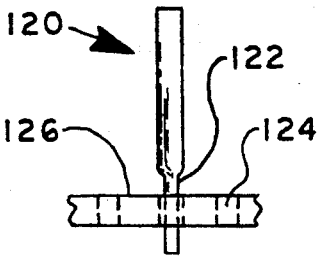
FIG. 7B is a side view of the forward portion of the device shown in FIG. 7A.
Figure 7A:
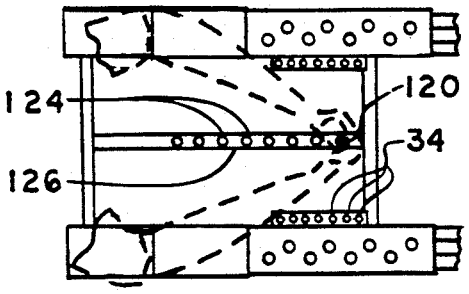
FIG. 7A is a detailed plan view of the forward portion of the device shown in FIG. 1 and showing a removable center grip.

FIGS. 7A and 7B provide detailed views showing the use of a central grip member 120 adjustably secured to the front platform. The grip member is designed to be grasped by the user's hands and remains stationary when the devise is in use. The grip is post-shaped and includes a reduced diameter bottom portion 122 that can be removably received within any one of a plurality for complementary apertures 124 located in central member 126. As shown, the apertures are linearly aligned with each opening oriented vertically. FIGS. 8–13 portray the device is use with the user positioned in a crawling stance. In FIGS. 8–11, each of the user's arms is positioned with the elbow located at the rear of the arm slide, the forearm located medially on the slide and the hand grasping the slide's grip 36. In FIGS. 8–13, each of the user's legs is positioned with the knee atop block 78 and pressing into the stop formed by member 82. The user's feet are oriented substantially vertically with the toe portion received within the rectangular cut-out of member 86.

Figure 8:
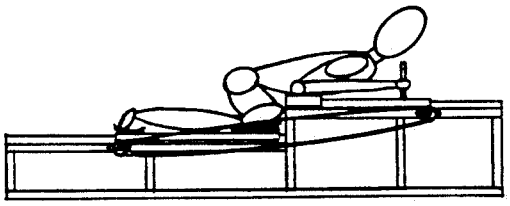
FIG. 8 is a side view of the device shown in FIG. 1 with a person shown in a first position atop the device.
Figure 9:
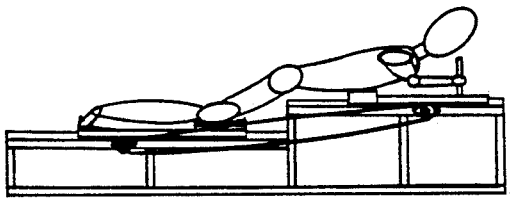
FIG. 9 is a side view of the device shown in FIG. 1 with a person shown in a second position atop the device.

FIGS. 8 and 9 show one method of use wherein the user simultaneously moves both arms forwardly while extending both legs rearwardly. It should be noted that since the arm slides freewheel as they move forwardly, most of the user's body movement will be centralized in the mid-body area and the user will tend to move forwardly on the device. The resistance to rearward motion of any of the slides is normally due to the inherent friction in the drive assembly (the two shafts 56, 90 and the connecting chain 102). This resistance is sufficient to provide the user with a stable support when he or she is supported by the slides. The user can adjust the brake assembly to add further resistance, if required.

FIG. 9 shows the user of FIG. 8 after having fully extended his arms and legs. The user now simultaneously retracts both of his arms and legs to thereby return to the position shown in FIG. 8. It should be noted that in returning to the retracted position, the rearward movement of the forward slides will be resisted by the gear train assembly while the forward movement of the leg slides will be almost effortless as the gears meshed to the leg slides freewheel on shaft 90.

Figure 10:
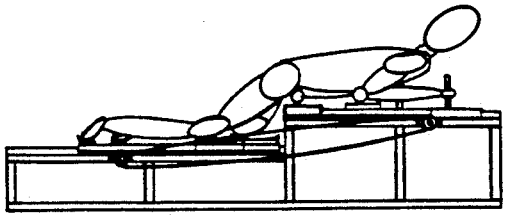
FIG. 10 is a side view of the device shown in FIG. 1 with a person shown in a third position atop the device.
Figure 11:
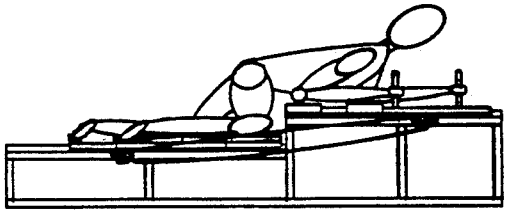
FIG. 11 is a side view of the device shown in FIG. 1 with a person shown in a fourth position atop the device.

FIGS. 10 and 11 show the device being used to perform a slightly different exercise in which the user alternates the motion of his opposite limbs as normally done while performing a crawling motion.

In FIG. 10, the user is shown in a modified crawling stance with his right side limbs fully extended and his left side limbs fully retracted. As shown the user is grasping each handle 36 with the associated hand. From the position shown in FIG. 10, the user next simultaneously retracts his right side limbs while extending his left side limbs. When completed, the user will be in the position shown in FIG. 11. To accomplish this movement, the user exercises his mid-body muscles in substantially the same manner as would occur if the user was crawling. This type of motion additionally requires a significant amount of limb coordination. Repeating these motions will improve the user's muscles as well as his coordination.

It should be noted that similar results will be obtained if an actual crawling type of movement is practiced. A user starts out with his right arm and left leg retracted and his left arm and right leg extended. The user then simultaneously extends his right arm and left leg while retracting his left arm and right leg.

Figure 12:
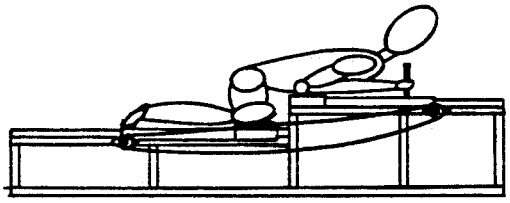
FIG. 12 is a side view of the device shown in FIG. 6 with a person shown in a fifth position atop the device.
Figure 13:
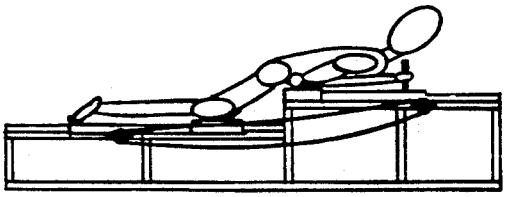
FIG. 13 is a side view of the device shown in FIG. 6 with a person shown in a sixth position atop the device.

FIGS. 12 and 13 show the device with the optional central handgrip/post 120 in use. The user grasps the central post with both hands while maintaining his elbows and the rear portion of his forearms upon the rearward portion of the associated arm slide 20. The user then performs the exercise by using his legs to move the leg slides in an oscillatory manner while maintaining the position of the forward portion of his body by holding on to the fixed post. In this manner, the user localizes the muscle strengthening action to the mid-body muscles.

The embodiments disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. An exercise device comprising:

a base having a front portion and a rear portion;

a first horizontally-oriented platform supported by the rear portion of said base;

a second horizontally-oriented platform supported by the front portion of said base and located adjacent to and in a separate horizontal plane above said first platform;

first and second slide members slidably engaged to said first platform wherein said slide members are constrained by a track means in said first platform wherein the slide members can only be moved in a linear horizontal path toward a front or rear portion of the first platform; and third and fourth slide members slidably engaged to said second platform wherein said slide members are constrained by a track means in said second platform wherein the slide members can only be moved in a linear horizontal path towards a front or rear portion of the second platform.

a transmission means interconnecting the first and second slide members in a cooperating relationship with the third and fourth slide members.

wherein a user exercises, by positioning himself on the device, assuming a crawling position, with the distal portion of his upper limbs engaging first and second slide members and the distal portion of his lower limbs engaging the third and fourth slide members, said user can then practice a crawling movement on the device to achieve a strengthening of the torso muscles as well as the muscles of the arms and legs.

2. The device of claim 1 further comprising an upwardly extending toe-receiving means adjustably connected to a rear portion of each of said first and second slide members wherein the toe-receiving means can be adjustably secured to the associated slide member in any one of a plurality of locations between a forward end of the slide member and a rearward end of the slide member.

3. The device of claim 1 further comprising:

a first grip member adjustably connected to the third slide member and slidable therewith;

a second grip member adjustably connected to the fourth slide member and slidable therewith; and wherein each of said grip members may be located at any one of a plurality of locations between a front end of the associated slide member and a rear end of the associated slide member.

4. The device of claim 1 further comprising:

a first rotatable shaft secured to said first platform;

a second rotatable shaft secured to said second platform;

first connector means that connects the first and second slide members to the first shaft wherein movement of said slide members in a first direction causes the first shaft to rotate; and second connector means that connects the third and fourth slide members to the second shaft wherein movement of said slide members in a first direction causes the second shaft to rotate.

5. The device of claim 4 wherein the first and second connector means includes a clutch means that enables the slide members to freewheel without causing the associated shaft to rotate when either of the slide members are moved in a second direction.

6. The device of claim 4 further comprising an adjustable brake means that can act on at least one of said shafts to thereby adjust the force required to rotate the associated shaft.

7. The device of claim 4 further comprising a third connector means that rotatably connects the first and second shafts wherein rotation of either of said shafts will cause the other of said shafts to rotate.

8. The device of claim 7 further comprising an adjustable brake means that acts on both of said shafts to thereby adjust the force required to rotate the shafts.

9. The device of claim 1 further comprising a central grip member adjustably connected to said base medially between the third and fourth slide members wherein the central grip member can be located at any one of a plurality of linearly spaced locations between the front and rear portions of the second platform.

10. An exercise device comprising;

a support base, a first track means operatively connected to said base;

a second track means operatively connected to said base; located adjacent to and in a separate horizontal plane below said first track means first and second arm support slide members movably connected to said first track means wherein said first slide member is constrained by said first track means to move in a linear and substantially horizontally first path, wherein said second slide member is constrained by said first track means to move in a linear and substantially horizontally second path and wherein said first and second paths are spaced apart and parallel to each other;

first and second leg support slide members operatively connected to said second track means wherein said first leg support slide member is constrained by said second track means to move in a linear and substantially horizontal third path, wherein said second leg support slide member is constrained by said second track means to move in a linear and substantially horizontal fourth path and wherein said third and fourth paths are spaced apart and parallel to each; and wherein each of said arm support slide members and said leg support slide members have an upper surface of the arm support slide members is located above and forward of the upper surface of the leg support slide members.

a transmission means interconnecting the first and second slide members in a cooperating relationship with the third and fourth slide members.

wherein a user exercises by positioning himself on the device, assuming a crawling position, with the distal portion of his upper limbs engaging first and second slide members and the distal portion of his lower limbs engaging the third and fourth slide members, said user can then practice a crawling movement on the device to achieve a strengthening of the torso muscles as well as the muscles of the arms and legs.

11. The device of claim 10 further comprising an upwardly extending toe-receiving means connected to a rear portion of each of said first and second leg support slide members.

12. The device of claim 10 further comprising:

a first grip member connected to the first arm support slide member and slidable therewith; and a second grip member connected to the second arm support slide member and slidable therewith.

13. The device of claim 10 further comprising:

a first rotatable shaft secured to said base;

a second rotatable shaft secured to said base;

first connector means that connects the first and second arm support slide members to the first shaft wherein movement of said slide members in a first direction causes the first shaft to rotate; and second connector means that connects the first and second leg support slide members to the second shaft wherein movement of said leg support slide members in a first direction causes the second shaft to rotate.

14. The device of claim 13 wherein at least one of the first or second connector means includes a clutch means that enables an associated slide member to move in a second direction without causing the associated shaft to rotate.

15. The device of claim 13 further comprising an adjustable brake means that can act on at least one of said shafts to thereby adjust the force required to rotate the associated shaft.

16. The device of claim 13 further comprising a third connector means that rotatably connects the first and second shafts wherein rotation of either of said shafts will cause the other of said shafts to rotate.

17. The device of claim 16 further comprising an adjustable brake means that acts on both of said shafts to thereby adjust the force required to rotate the shafts.

18. The device of claim 10 further comprising a central grip member connected to said base and located medially between the first and second arm support slide members.

19. The device of claim 10 wherein the first and second paths are vertically above and parallel to the third and fourth paths.

* * * * *